US005381298A

United States Patent [19]

Shaw et al.

[11] Patent Number: 5,381,298

[45] Date of Patent: Jan. 10, 1995

[54] ELECTRIC FENCE CHARGER

[75] Inventors: David L. Shaw; Gerald D. Wyatt, both of Rochester, Minn.

[73] Assignee: Waters Instruments, Inc., Rochester, Minn.

[21] Appl. No.: 942,740

[22] Filed: Sep. 9, 1992

[51] Int. Cl.[6] ..... H05C 1/04

[52] U.S. Cl. ..... 361/232; 307/108

[58] Field of Search ..... 307/104, 106, 108, 132 R, 307/132 E, 132 M; 256/10; 361/232; 315/206, 209 R, 209 T, 209 CD

[56] References Cited

U.S. PATENT DOCUMENTS

| | | | |
|---|---|---|---|
| 3,466,146 | 2/1971 | Breeze, III et al. | 307/132 |
| 3,655,994 | 4/1972 | Malme | 307/132 |
| 3,655,995 | 4/1972 | Malme | 307/132 |
| 3,772,529 | 11/1973 | Boeing | 307/132 |
| 3,868,545 | 2/1975 | Caron | 315/209 |
| 3,900,770 | 8/1975 | Kaufman | 361/132 |
| 3,998,594 | 10/1976 | Low et al. | 307/132 R |
| 4,037,269 | 7/1977 | Ferguson | 361/232 |
| 4,114,185 | 9/1978 | Gallagher | 361/232 |
| 4,200,809 | 4/1980 | Madsen | 307/132 |
| 4,270,735 | 6/1981 | Gavin | 307/132 E |
| 4,316,232 | 2/1982 | Phillips et al. | 361/232 |
| 4,394,583 | 7/1983 | Standing | 307/132 R |
| 4,396,879 | 8/1983 | Weinreich et al. | 256/10 |
| 4,548,209 | 10/1985 | Wielders et al. | 128/419 |
| 4,560,827 | 12/1985 | Langlie et al. | 174/52 |
| 4,595,009 | 6/1986 | Leinders | 128/419 |
| 4,691,084 | 9/1987 | Standing | 191/12.2 |
| 4,800,883 | 1/1989 | Winstrom | 128/419 |
| 4,830,006 | 5/1989 | Haluska et al. | 128/419 |
| 4,859,868 | 8/1989 | McKissack | 307/106 |

*Primary Examiner*—Jeffrey A. Gaffin
*Attorney, Agent, or Firm*—Fredrikson & Byron

[57] ABSTRACT

The invention provides an electric fence charger of the type that periodically provides high voltage electrical shock pulses through an electric fence wire. The fence charger has a low voltage power source that powers the fence charger and supplies a charging current. An energy converter converts the low voltage and charging current of the power source to high voltage for storage in a high voltage storage means. A timer emits pulse discharge control signals on a periodic basis and these control signals are used to control discharge of the stored high voltage for delivering shocking pulses into the fence wire. A regulator adjusts operation of the energy converter to provide a minimum high voltage energy level as long as the power source voltage exceeds an established power source voltage reference. In another embodiment of the invention, a fence charger employs a DC-DC flyback converter for charging a high voltage storage means to a discharge voltage level which provides a minimum shock energy pulse. This embodiment includes means for operating the flyback converter at a constant frequency and means responsive to battery voltage for changing the flyback converter duty cycle to regulate the discharge voltage level.

22 Claims, 1 Drawing Sheet

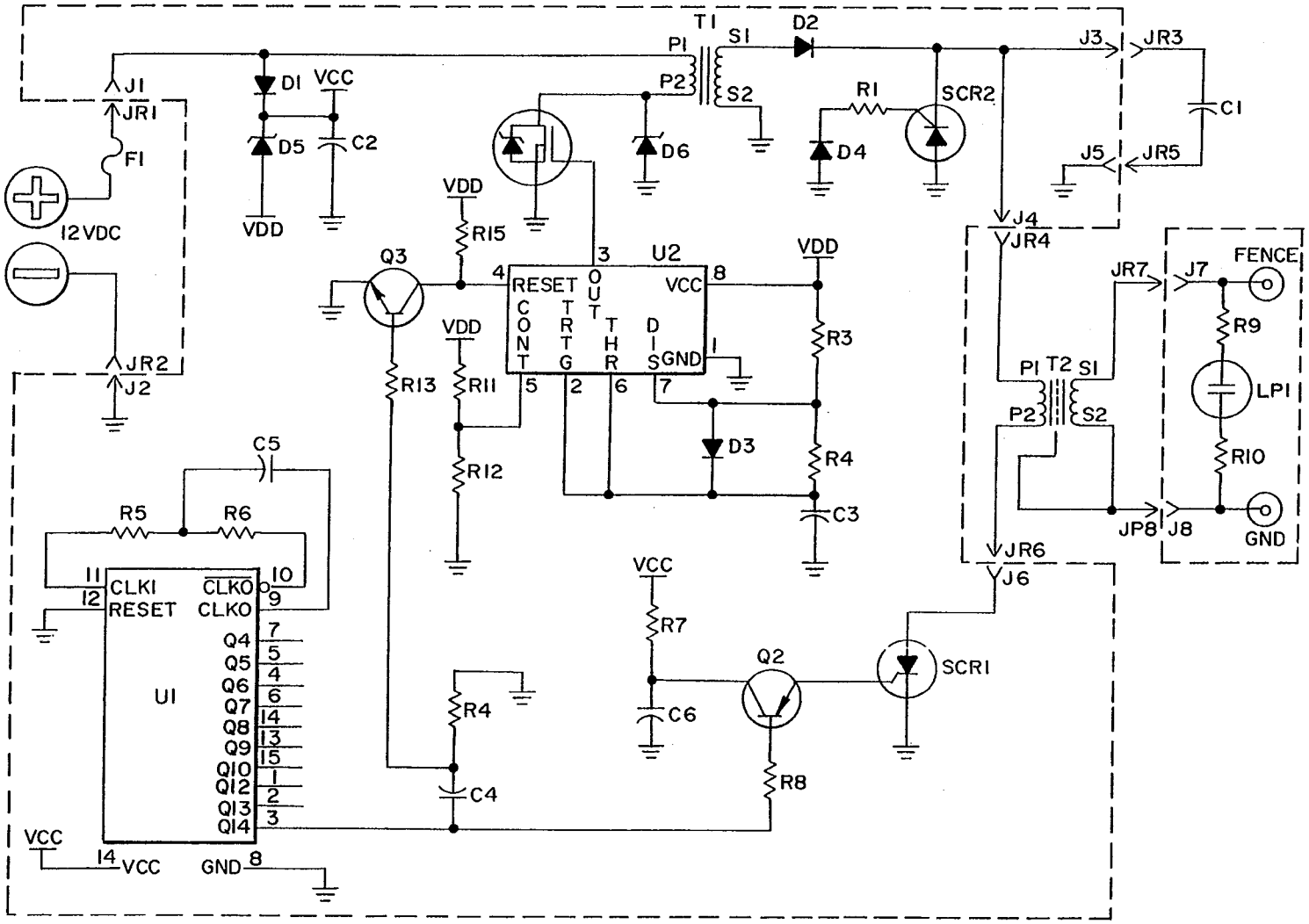
FENCE
GND
LP1
R9
R10
J7
J8
JR7
JP8
C1
JR3
JR5
J3
J5
J4
JR4
T2
S1
S2
P1
P2
JR6
J6
SCR2
SCR1
R1
D4
D2
T1
D6
VDD
R3
R4
C3
D3
Q2
R8
U2
VCC
GND
RESET
OUTPUT
CONTROL
THRESH
TRIG
DISCH
R7
C6
R15
R11
R12
Q3
R13
C4
C2
D1
D5
C5
R6
R5
U1
CLKO
CLKI
Q4
Q5
Q6
Q7
Q8
Q9
Q10
Q12
Q13
Q14
J1
JR1
F1
12VDC
JR2
J2

ELECTRIC FENCE CHARGER

BACKGROUND OF THE INVENTION

1. Field of Invention

This invention relates to an electric fence charger and more particularly to an improved DC-DC voltage converter that maintains a relatively constant voltage output within a specified battery operating voltage range and halts operating upon discharge of the DC battery below a specified battery discharge reference voltage.

2. Description of the Prior Art

As is well known, electric fence chargers have been used for many years to impress shocking potentials on wire fences to train cattle or farm animals generally from straying beyond predetermined boundaries. Electric fence chargers provide electrical pulses to the fence wire that are spaced apart by either a constant or variable time and which inflict electric shocks to an animal contacting the wire.

Electric fence chargers are designed to operate under a number of constraints to minimize the risk of electrocution and to continue to operate under severe weather and temperature conditions. In addition, fence chargers are preferably designed to operate at power levels too low to pose the risk of starting a fire in dry wood or plants. And since the fence chargers are typically powered by a low voltage, rechargeable storage battery, it is important that the fence charger operate the charger fence intermittently to provide the narrow pulse width pulses every second or so.

Early fence chargers were constructed with a mechanical oscillator, wherein an induction coil is charged and discharged by spring loaded oscillating switch. Such chargers in practice proved costly by reason of inordinate drains on the power supply and failures through shorting of the associated fence wire or because of arcing between the contacts of the oscillating switch. More recently, electronic circuit fence chargers have been developed which substitute electronic oscillators for mechanical oscillators that periodically switch current through output step-up transformers to provide the requisite high voltage potential to be discharged through the fence wire. Such electric fence chargers are shown, for example, in U.S. Pat. No. 3,772,529.

Usually, currently available fence chargers apply narrow width, high voltage, low current electric pulses generated through a DC-DC converter and electronic timing circuits associated therewith from a low voltage, rechargeable battery, such as a deep-discharge, 12 volt, lead acid vehicle or boat battery. The 12 volt batteries are typically recharged periodically after they are discharged as current is drawn by the electric fence charging circuit.

The fence wire to be charged normally presents a very high resistance, capacitive load, that is proportional to the length of the wire, when the fence is "unloaded". The average fence may have a capacitance between 0.015 microfarads to as much as 0.1 microfarads or even higher depending on the length of the fence wire. If the fence wire is "loaded" by water, ice, moist weeds or the like, or if an animal body contacts the wire, or the wire is on the ground, a resistance on the order of less than a thousand ohms may be presented to the output of the fence charger. The load presented may affect the current drawn by the charger and draw down the battery voltage to a point where the battery may be permanently damaged.

Apart from the accidental excess discharge of the battery, the inefficiency of the normally operating voltage converter circuit may cause the battery energy to become depleted to a damaging level before attention is given to recharging the battery.

Accordingly, a need exists for a reliable, energy efficient electric fence charger which avoids excess discharge and damage to the battery.

A need also exists for a DC-DC converter circuit that insures that the electric fence shock pulse voltage remains relatively constant in the operating range of the battery between full charge and a discharge reference voltage.

A further need exists for safely discharging any residual high voltage on the high voltage capacitor after the battery voltage falls to the discharge reference voltage.

SUMMARY OF THE INVENTION

It is thus an object of the present invention to provide an electric fence charger circuit that is energy efficient and avoids excess discharge of the battery.

Is still another object of the present invention to provide a fence charger having a voltage regulator for compensating for battery depletion and for extending the life of the battery.

It is a further object of the invention to provide an electric fence charger which employs a DC-DC converter for converting a low voltage supplied from a low voltage battery to a high voltage and circuitry for periodically energizing a fence wire and having a voltage regulator for controlling the duty cycle of the DC-DC converter as a function of battery voltage.

It is a still further object of the present invention to preclude a DC-DC converter from drawing current from a battery power supply which is depleted to a minimum discharge voltage.

It is a further object of the present invention to ensure that residual charges on the high voltage capacitor in a DC-DC converter fence charger are discharged when battery voltage falls to a discharge voltage reference.

These and other objects of the present invention are realized in an electric fence charger of the type that periodically provides high voltage electrical shock pulses through an electric fence wire comprising a source of electrical power, a timing circuit coupled to the source of electrical power for emitting pulse discharge signals on a periodic basis, high voltage power storage means coupled to the timing means and to the electric fence wire for storing high voltage energy and discharging high voltage energy pulses into the electric fence wire under the control of the periodically generated pulse discharge signals, DC-DC converter means coupled between the low voltage power source and the high voltage energy storage means and operable to convert low voltage energy derived from the low voltage power source to high voltage energy stored in the high voltage energy means, and regulator means responsive to the power source voltage for maintaining a minimum voltage level on the high voltage energy storage means.

Preferably, the regulator means alters the operation of the DC-DC converter means as a function of a voltage proportional to the power source voltage, e.g. by altering the duty cycle of the flyback oscillation of the converter.

Preferably, the DC-DC converter is disabled by means responsive to the voltage level of the low voltage power source for inhibiting the operation of the DC-DC converter means when the battery voltage falls below a discharge voltage reference.

An electric fence charger is thus provided of the type that periodically provides high voltage electrical shock pulses through an electric fence wire employing a DC-DC flyback converter and high voltage regulator that provides a minimum shock energy pulse over the operating range of a rechargeable low voltage battery. The high voltage regulator acts to alter the duty cycle of the converter as a function of current battery voltage to achieve a minimum energy charge on an output capacitor within a range of acceptable battery voltages.

The charger circuit responds to the discharge of the battery below a discharge reference voltage by inhibiting the operation of the flyback converter when the power supply voltage falls below the discharge reference voltage. The converter further includes a high voltage storage capacitor for storing converted high voltage, a transformer having an input winding of a first number of turns coupled to the low voltage battery and a charge control switch and an output winding of a second number of turns coupled to the high voltage storage capacitor, a pulse energy discharge switch, and the primary winding of a step-up transformer which is coupled by its secondary winding to the fence wire. The charge control switch and the discharge switch are controlled by an oscillator and a timer, respectively, that generate charge control and discharge control signals to charge the storage capacitor to a high voltage over a fixed charging time period and to discharge the voltage into the primary winding of the step-up transformer at the end of the period.

The oscillator generates the charge control signals at a frequency and with a duty cycle that increases in direct proportion to the decrease in the output voltage of the battery in a range from full charge voltage to the discharge reference voltage in order to attain a relatively constant voltage on the high voltage capacitor during the fixed charging time period. The oscillator is inhibited for a reset period in response to the discharge control signal. The oscillator is also inhibited when the battery voltage falls below the discharge reference voltage. However, the timer remains energized in order to generate the discharge control signals and to discharge any residual charge on the high voltage capacitor.

BRIEF DESCRIPTION OF THE DRAWING

These and other objects, advantages and features of the present invention will become apparent from the following description of the preferred embodiment thereof taken in conjunction with the drawing in which the sole FIGURE is an electrical schematic diagram of the electric fence charger circuit of the present invention.

DESCRIPTION OF THE PREFERRED EMBODIMENT

Generally speaking, it is necessary to employ a DC-DC converter to convert electrical energy from a low voltage DC power supply or battery to a high voltage energy level stored in a high energy storage capacitor in order to provide a shocking pulse. A typical form of DC-DC converter is commonly referred to as a flyback converter which employs a transformer having a primary winding in series with a primary power supply and secondary winding in series with the high energy capacitor. An interrupting circuit or switch is placed in series with a primary coil and battery. Charging of the high energy capacitor is accomplished by inducing a voltage in the primary winding of the transformer creating a magnetic field in the secondary winding. When the current in the primary winding is interrupted by opening the interrupting switch, the collapsing field develops a current in the secondary winding which is applied to the high energy capacitor to charge it.

The repeated interruption of the supply current by opening the interrupting switch charges the high energy capacitor to a desired level over time. The charging time is dependent on a number of factors, including the desirable voltage level, the power supply voltage level, the ratio of the number of turns of the secondary winding of the primary winding of the transformer, other characteristics of the transformer, the level of residual voltage stored by the high energy capacitor at the beginning of the charge cycle, and the "duty cycle" of the closed time to the open time of the interrupting switch. Generally, the greater the existing charge on a high voltage capacitor, the less time is required for it to store an additional unit of energy. The charging time is the greatest when the high energy capacitor is completely uncharged at the beginning of the charging cycle.

Typically an electronic oscillator is employed to close and open the interrupting circuit or switch. In accordance with a present invention, as the supply voltage of the battery power supply drops, the duty cycle closed time increases.

In accordance with the present invention, a DC-DC converter arranged as a flyback regulator converts an input battery voltage of 9.5 to 13 VDC to 430 VDC stored in a high voltage capacitor in the interval between shock pulses. The stored voltage is regulated by means of pulse-width modulation (PWM) circuitry which controls the duty cycle ratio of closed to open time of a primary winding switch. For this flyback switching supply, the longer the closed time compared to the open time, i.e. the greater the duty cycle, the more energy is stored in the transformer and transferred to the high energy capacitor load.

The 430 VDC energy is discharged into the fence wire through a further step-up transformer at an interval of about 1.4 seconds. Pulses in excess of 4000 VDC are delivered to the fence wire coupled to the secondary winding of the transformer under the control of a timer circuit which discharges the stored energy into the primary winding of the transformer.

Referring now to the FIGURE, first and second circuit power supply voltages VDD and VCC are indirectly supplied by the 12 VDC battery through diodes D1 and D5 and capacitor C2. Diode D1 provides isolation for components supplied by VCC and VDD and eliminates any negative potential on VCC and VDD generated by reverse EMF of transformer T1. Zener diode D5 has a voltage drop of 6.2 volts and sets the voltage VDD at current battery voltage less the 6.2 volt drop and the 0.5 volt drop of the diode D1. Capacitor C2 supplies VCC power at battery voltage less the 0.5 volt diode drop to digital timer U1 and its associated components. The VCC voltage on capacitor C2 remains for a time after the battery is disconnected from terminals J1,J2.

After disconnection or discharge of the battery below a threshold of 8.5 volts, the VDD supply voltage is insufficient to power the components it is connected to. However, digital timer U1 remains powered by the VCC supply in order to discharge the high energy storage capacitor C1 in a manner to be described. This feature allows the repair technician to work on the circuit without the threat of a high voltage shock. For example, if in a low battery voltage situation, digital timer U1 were to stop before oscillator U2, capacitor C1 could charge to 640 VDC without discharging. This situation would cause a high voltage shock to anyone contacting high energy storage capacitor C1. Diode D5 ensures that oscillator U2 stops oscillating before timer U1 to prevent this situation. The zener voltage (6.2 volts) of diode D5 sets the supply voltage VDD to oscillator U2 at a lower potential than the supply voltage VCC to timer U1 causing oscillator U2 to stop oscillating first.

Referring now to the flyback converter operation of the circuit, the switching MOSFET Q1 is arranged in series with the 12 VDC battery coupled to terminals J1, J2 and the primary winding P1-P2 and controlled by the pulse width modulated (PWM) oscillator circuit U2 to allow current to flow through the primary winding. When MOSFET Q1 is rendered conductive by an output signal from the OUT terminal of oscillator circuit U2, the current increases linearly in the primary winding P1-P2 of the pot core transformer T1. The slope of this current ramp is $V_{in}/L_{pri}$. Transformer T1 is actually an inductor with a secondary winding S1-S2 and, unlike a normal transformer, it stores substantial energy in its core when conducting current.

When the output signal ceases, MOSFET Q1 turns off and the field in the transformer core begins to collapse causing the secondary current ($I_{sec}$) to flow. The drain-to-source voltage of MOSFET Q1 flies back to a voltage equal to the sum of the input voltage plus the turns ratio multiplied by the output voltage (plus a diode drop). For this circuit, $$\begin{aligned} V_{flyback} &= V_{in} + (N_1/N_2)V_{out} + V_{sat} \\ &= 12 + (25/270)425 + 1 \\ &= 52.35 \text{ volts} \end{aligned}$$

The secondary current $I_{sec}$ induced by the collapse of the field charges high energy capacitor C1. The diode D2 prevents the stored voltage on capacitor C1 from leaking back through the secondary winding S1-S2 of transformer T1. The secondary current $I_{sec}$ during the flyback period is a declining ramp with a slope of $-V_{out}/L_{sec}$.

The flyback period continues until the core of transformer core T1 is depleted of energy. This is referred to as a discontinuous mode of operation. This mode can be seen by viewing the voltage across MOSFET Q1 and determining if the flyback voltage returns to the input voltage level before the MOSFET Q1 is turned back on again. There is some tinging during this time since both MOSFET Q1 and diode D2 are turned off, leaving transformer T1 completely unloaded.

Zener diode D6 is a transient voltage suppressor that protects MOSFET Q1 from overvoltage damage caused by flyback transients. Diode D6 has a breakdown voltage of 62 VDC and a response time of less than 1 ns. It is physically located as close to MOSFET Q1 as possible to minimize transient overshoot due to capacitance coupling on the board.

The high energy storage capacitor C1 presents a 15 microfarad load to the secondary winding S1-S2 and stores 1.4 joules of energy at 430 volts when charged during a 1.4 second period, for example. Capacitor C1 is completely discharged every 1.4 seconds, for example, through the primary winding P1-P2 of the step-up transformer T2. For this reason, the discharged capacitor C1 behaves as a large load during the recharge cycle. In conventional designs it is customary to use a closed loop system to shut down the flyback converter and wait for the load demand to catch up with the power delivery capability. This concept would not work in this application since the capacitive load is dynamic and dependent on the voltage applied to it. The converter must be designed to power the worst case load, the fully discharged capacitor C1.

Turning now to the discharge circuitry and cycle, the load of the flyback converter, capacitor C1, is used as an high energy storage source for the shocking pulse applied to the fence wire. The energy stored is switched by SCR1 through a step-up transformer T2 and applied as a 4000+ VDC pulse during a pulse width that depends on how long it takes for the high voltage capacitor C1 to discharge through the primary winding P1-P2 of step-up transformer T2 and SCR1. The output shock is conducted through an electrically conductive fence wire connected to the FENCE output terminal. Load resistors R9 and R10 and gas discharge tube LP1, which flashes in response to the pulse, are also coupled across the FENCE and GND terminals.

The pulse energy discharge occurs about every 1.4 seconds. This interval is chosen because it is an effective rate to prevent farm animals from passing through the fence, it is long enough to require a reasonably small energy consumption from the 12 VDC power supply, and it is long enough to pass Underwriters Laboratories' requirements for safety issues. The voltage to penetrate animal fur must be at least 2,000 volts to be effective, and an animal's body impedance is typically 500 ohms. Consequently, the 4000+ VDC pulse is selected to provide a margin of error while still satisfying safety limits.

The 1.4 second interval is established by the digital timer U1 which is powered from the VCC voltage which itself is proportional to the actual voltage of the 12 VDC battery coupled to terminals J1,J2. The digital timer U1 contains an astable oscillator that develops a 11.9 KHz clock signal and a divider that divides the clock signal until a 686 ms. trigger signal is emitted once every 1.372 seconds from pin Q14 once every 1.4 seconds. Precision resistor R6 forms an RC time constant with precision capacitor C5 to produce the astable 11.9 KHz clock frequency. Precision resistor R5 stabilizes the clock frequency of the oscillator of timer U1 to produce the 50% duty cycle clock signal of 686 ms.

The trigger signal is applied through current limiting resistor R8 to the base of transistor Q2 to cause it to conduct current to the gate of SCR1 and render it conductive. Capacitor C6 stores energy to deliver a large enough current surge when transistor Q2 is rendered conductive to turn on the gate of SCR1 hard and to prevent the device from heating when it conducts the stored energy of capacitor C1. Resistor R7 isolates supply VCC from the gate of SCR1 and provides a current path to charge capacitor C6. When the gate of SCR1 is triggered, it becomes the same potential as ground. If R7 were not in place, supply VCC would be grounded when SCR1 fired. When SCR1 is triggered on, it effectively shorts high energy storage capacitor C1 through the primary winding P1-P2 of the step-up transformer T2 to provide the high voltage shocking pulse.

When the energy of capacitor C1 is dumped through transformer T2, most of the energy is transferred to the fence wire. If the load impedance of the fence does not match the impedance of step-up transformer T2, there is not a 100% energy transfer, and some of the energy is reflected back into the primary winding P1-P2 of transformer T2. This reflected energy reverses the magnetic domains in transformer T2 causing a reverse stored EMF (back EMF). This back EMF continues to forward bias SCR1.

The back EMF is in reverse polarity to the potential initially stored on capacitor C1 and can then forward bias SCR2 to dissipate it. If this back EMF were not dissipated, it would be reflected back to the fence wire as a negative voltage. This negative voltage would extend the pulse duration on the fence and exceed the safety limits set by Underwriters Laboratories.

Diode D4 and resistor R1 conduct current generated by the back EMF of transistor T2 to the gate of SCR2 to render it conductive. Resistor R1 limits the current to the gate of SCR2 from the back EMF of transistor T2 to 90 mA. The 450 A surge generated by the back EMF may damage diode D4 and the gate of SCR2 if resistor RI were not present.

The trigger pulse generated by digital timer U1 serves a second purpose. At the same time that it triggers SCR1, it is applied to the RC network of resistors R13 and R14 and capacitor C4 coupled to the base of transistor Q3 to render it conductive. Transistor Q3 is normally held non-conducting by the coupling of its base terminal to ground through resistors R13 and R14, and the RESET terminal is normally held at voltage VDD through resistor R15. When transistor Q3 conducts, a ground potential signal resets 555 timer U2 and causes the flyback oscillator to stop running for 10 ms. The 10 ms. period is established by the time constant of resistor R13 and capacitor C4. The 10 ms. reset period is necessary because energy generated by operation of the flyback converter would continue to forward bias SCR1 and the capacitor C1 would remain in the discharge mode. Resistor R15 also isolates the VDD supply when transistor Q3 is rendered conductive.

Turning now to the operation of the oscillator U2 during the charging cycle, it constitutes a 555 timer (ICM 7555 available from GE-Intersil Inc.) which is configured as an oscillator that incorporates a voltage to duty cycle control. Unlike the conventional method of feeding back the output voltage achieved on the storage capacitor C1 or monitoring the current flowing through the primary coil P1-P2 to regulate the oscillator, the supply voltage reduced by the zener diode D5 voltage drop ( i.e., VDD) and divided by precision resistors R11 and R12 is monitored at control terminal CONT for duty cycle control.

As the supply voltage of the battery drops, the duty cycle of the output signal at terminal OUT increases and increases the flyback charging rate of capacitor C1 during the 1.4 second charging period. This charges capacitor C1 to the specified 430 VDC voltage consistently and independently of the supply voltage within the specified source voltage operating range. This, in turn, produces the rated output energy of the shocking pulses independently of the supply voltage drop accompanying normal depletion of the battery.

The oscillating frequency and duty cycle control is established by the voltage divider and RC time constant network of resistors R3 and R4, diode D3 and capacitor C3. Diode D3 rectifies internal components of oscillator U2 to provide a fixed frequency, duty cycle adjustable control. Precision resistor R4 influences the duty cycle of oscillator U2. Precision resistor R3 influences the astable running frequency of oscillator U2, which in this case is 14 KHz. Precision capacitor C3 forms a time constant with resistors R3 and R4 for frequency and duty cycle control.

To reduce the risk of damage to the battery caused by an excessively deep discharge, the 555 circuit U2 stops running when the battery supply voltage is below 8.5 volts, which results in a VDD voltage of less than 2 volts at pin 8 (VCC terminal) of 555 circuit U2. In contrast, conventional flyback regulators feedback the output voltage on the high voltage capacitor through an error amplifier that controls a pulse width modulator circuit to shorten the duty cycle. If this fence controller circuit used such a method, it would never charge capacitor C1 in 1.4 seconds, because the control circuit would limit the flyback effect as the capacitor C1 began to charge and slow the rate of charge.

The following description concerns operating specifications and design considerations affecting power output and operating efficiency. The low impedance load presented by animal bodies forces the primary winding turns $N_1$ to the secondary turns $N_2$ ratio ($N_1$:$N_2=\alpha$) of the step-up transformer T2 to be low for maximum power transfer ($Z_{in}=\alpha^2 * Z_{out}$). The output transformer T2 used in this circuit has a 1:11.6 turns ratio.

The output voltage of a discharge shock delivered to the fence depends on the length of the fence. The controller output voltage ratings employed by the assignee of this application take this into account. In this particular design, 430 VDC discharged from capacitor C1 produces 2000 VDC on a twenty-five mile long fence. By selecting twice the minimum effective shock voltage for an effective margin, or 4000 VDC, dictates that the voltage on capacitor C1 must be at least 4000 VDC/11.6=345 VDC to produce an effective fence voltage under various complex loads. For this circuit, 430 VDC is chosen for C1.

The ideal flyback converter circuit is lossless since the ideal switch has either zero voltage or zero current at any time. In practice there are some switching losses in MOSFET Q1 and losses in diode D2, capacitor C1, and transformer T1. The switching losses in the MOSFET Q1 are primarily dependent on the switching frequency and crossover period. The equation relating these parameters is as follows.

$$P_{swt} = 1/2(VCC * I_{dpk} * t_c * f), \text{ where } VCC = \text{supply voltage}$$

$$= 4.7 \text{ mW} \quad I_{dpk} = \text{peak current from drain to source}$$

$$t_c = \text{crossover period}$$

$$f = \text{switching frequency}$$

$$\% \text{ Loss} = 4.7 \text{ mW}/993.7 \text{ mW} * 100\% = 0.48\%$$

The losses associated with the rectifier D2 are the forward voltage drop and reverse recovery time. The forward voltage drop is 0.7 v or 0.16% (Vf/Vout=07/425) loss. The reverse recovery time is 75 ns or 0.11% (trr/period=75 ns/68.9 μs) loss. This gives the diode rectifier D2 an overall loss of 0.27%.

The choice for the size of capacitor C1 is dependent on the fence load requirements and the flyback converter's limitations. This unit is rated at 1 joule output energy. The output transformer is 70% efficient. The discharge capacitor must store 1 J/70%=1.4 J. The flyback converter must be capable of producing 430 VDC on capacitor C1 in 1.4 seconds. If a capacity of 15 μF is chosen for capacitor C1, it then stores 0.5*15 μF*$430_2$=1.4 J.

Capacitor C1 has a self discharge time greater than 3000 seconds for its 900 VDC rated voltage. This means that for each pulse supplied by the flyback converter approximately 16 μV (900 v/3000 s=0.3 v/s=16.5 μV/ON time) is lost due to self discharge. There are 19.6K pulses per 1.4 second charge (14 kHz*1.4 s=19.6K). The average voltage per pulse is 430 v/19.6K pulses=21.9 mV/pulse and corresponds to a 0.073% loss (16 μV/21.9 mV).

The equivalent series resistance of capacitor C1 is 0.012 ohms at 14 kHz. The average charge current is 10 mA. The loss due to ESR is $0.01_2$*0.012=0.0012 mW or 0.12%.

The pot core transformer T1 is used in a unipolar discontinuous mode. The flux density is $B_{p\text{-}p/2}=(B_{sat}-B_{residual})/2$ or 4400−1000/2=1700 gauss. From the manufacturer's data on the 3C81 ferrite material used, the core loss at this flux density and an operating frequency of 14 KHz is 71 mW/cm³. The volume of the 22 mm×13 mm cylindrical core is 2 cm³ corresponding to a 142 mW loss or 14% loss for this 1:36 voltage conversion. This is by far the largest loss in the circuit. Typical flyback regulators have a 22% loss and a voltage conversion of 1:10.

The control circuit requires 4.5 mA from the 12 V source to operate. This accounts for 5.5% loss.

The total loss is approximately 20%. This agrees with the calculated efficiency taken from $E_{out}/E_{in}$*100%=(0.5*15 μF*430 V²)/(1.4 s*12.4 V*100 mA)*100%=80%.

While the best mode and preferred embodiment of the present invention has been described in detail, it will be understood that various changes, adaptations and modifications may be made therein without departing from the spirit of the invention and the scope of the appended claims.

What is claimed is:

1. An electric fence charger of the type that periodically provides high voltage electrical shock pulses through an electric fence wire comprising:

a low voltage electrical power source for powering the electric fence charger and supplying a charging current;

high voltage storage means for storing high voltage;

energy conversion means coupled between the low voltage power source and the high voltage storage means and operable to convert the low voltage and charging current derived from the low voltage power source to high voltage energy stored in the high voltage storage means;

timer means powered by the source of electrical power for emitting pulse discharge control signals on a periodic basis;

means for discharging the high voltage storage means and delivering high voltage shocking pulses into the electric fence wire under the control of the periodically generated discharge control signals;

means for establishing a power source voltage reference; and regulator means responsive to the voltage reference and the power source voltage for adjusting the operation of the energy conversion means to provide a minimum high voltage energy level as long as the power source voltage exceeds the voltage reference.

2. The electric fence charger of claim 1 wherein the regulator means further comprises:

low voltage inhibiting means responsive to the voltage level of the low voltage power source for inhibiting the operation of the energy conversion means when the power supply voltage falls below the power source voltage reference.

3. The electric fence charger of claim 2 further comprising:

discharge control inhibiting means for inhibiting operation of the energy conversion means for a predetermined time interval in response to a discharge control signal.

4. The electric fence charger of claim 3 further comprising:

means for energizing the timer means after the low power source voltage inhibiting means inhibits the oscillator means in order to generate the discharge control signals and to discharge any residual charge on the high voltage storage means.

5. The fence charger of claim 2 wherein said energy conversion means further comprises:

a transformer having an input winding of a first number of turns coupled to the low voltage power source and an output winding of a second number of turns coupled to the high voltage storage means and the energy discharge means;

normally open switch means coupled to the primary winding for allowing charging current to flow through the primary winding from the low voltage power source when closed in response to a charge control signal;

oscillator means coupled to the normally open switch means and responsive to the power supply voltage for generating charge control signals having a frequency and duration dependent on the power supply voltage, whereby current flow through the primary winding is effected and interrupted, causing the inducement of charging current in the secondary winding by the collapse of the electric field in the primary winding for charging the high voltage storage means to a constant high voltage independent of the power supply voltage in the period between successive discharge control signals.

6. The electric fence charger of claim 5 further comprising:

discharge control signal inhibiting means for inhibiting operation of the oscillator means for a predetermined time interval in response to a discharge control signal.

7. The electric fence charger of claim 5 further comprising:

means for energizing the timer means after the low power source voltage inhibiting means inhibits the oscillator means in order to generate the discharge control signals and to discharge any residual charge on the high voltage storage means.

8. The electric fence charger of claim 2 further comprising:

means for energizing the timer means after the low power source voltage inhibiting means inhibits the conversion means in order to generate the discharge control signals and to discharge any residual charge on the high voltage storage means.

9. The electric fence charger of claim 1 further comprising:

discharge control inhibiting means for inhibiting operation of the energy conversion means for a predetermined time interval in response to a discharge control signal.

10. An electric fence charger of the type that periodically provides high voltage electrical shock pulses through an electric fence wire employing a DC-DC flyback converter for charging a high voltage storage means to a discharge voltage level that provides a minimum shock energy pulse over the operating range of a rechargeable low voltage battery comprising:

means for operating said flyback converter at a constant frequency; and means responsive to the battery voltage for changing the flyback converter duty cycle to regulate the discharge voltage level.

11. The electric fence charger of claim 10 further comprising:

means for setting a battery discharge reference voltage; and low battery voltage inhibiting means responsive to the discharge of the battery below the discharge reference voltage for inhibiting the operation of the flyback converter.

12. The electric fence charger of claim 11 wherein the oscillator further comprises:

means for generating the charge control signals at a constant frequency and with a duty cycle that increases in proportion to the output voltage of the battery in a range from full charge to the discharge reference voltage in order to attain a relatively constant voltage on the high voltage capacitor during the fixed charging time period.

13. The electric fence charger of claim 12 wherein the low battery voltage inhibiting means inhibits the oscillator when the battery voltage falls below the battery discharge reference voltage.

14. The electric fence charger of claim 10 wherein said DC-DC converter further comprises:

a charge control switch;

a discharge control switch;

a high voltage storage capacitor for storing converted high voltage;

a step-up transformer having a primary winding of a first number of turns and a secondary winding of a second number of turns coupled to the fence wire;

an energy conversion transformer having an input winding of a first number of turns coupled to the low voltage battery and the charge control switch and an output winding of a second number of turns coupled to the high voltage storage capacitor and to the pulse energy discharge switch and the primary winding of the step-up transformer;

an oscillator for generating charge control signals applied at a charging frequency to the charge control switch to close and open the charge control switch at a repetitive duty cycle to charge the storage capacitor to a high voltage over a fixed charging time period; and discharge control means for generating the discharge control signals at the fixed charging time period for discharging the high voltage storage capacitor into the primary winding of the step-up transformer at the end of the period.

15. The electric fence charger of claim 12 further comprising:

discharge control signal inhibiting means for inhibiting the oscillator for a reset period in response to the discharge control signal.

16. The electric fence charger of claim 15 further comprising:

means for energizing the timer means after the low battery voltage inhibiting means inhibits the oscillator in order to generate the discharge control signals and to discharge any residual charge on the high voltage capacitor.

17. The electric fence charger of claim 11 further comprising:

discharge control signal inhibiting means for inhibiting the oscillator for a reset period in response to the discharge control signal.

18. The electric fence charger of claim 11 wherein the low battery voltage inhibiting means inhibits the oscillator when the battery voltage falls below the battery discharge reference voltage.

19. The electric fence charger of claim 18 wherein the oscillator further comprises:

means for generating the charge control signals at a frequency and with a duty cycle that increases in proportion to the output voltage of the battery in a range from full charge to the discharge reference voltage in order to attain a relatively constant voltage on the high voltage capacitor during the fixed charging time period.

20. The electric fence charger of claim 11 further comprising:

means for energizing the timer means after the low battery voltage inhibiting means inhibits the oscillator in order to generate the discharge control signals and to discharge any residual charge on the high voltage capacitor.

21. The electric fence charger of claim 20 wherein the oscillator further comprises:

means for generating the charge control signals at a constant frequency and with a duty cycle that increases in proportion to the output voltage of the battery in a range from full charge to the discharge reference voltage in order to attain a relatively constant voltage on the high voltage capacitor during the fixed charging time period.

22. The electric fence charger of claim 21 further comprising:

timer means for periodically discharging high voltage shock pulses into the electric fence; and means for energizing the timer means after the low battery voltage inhibiting means inhibits the DC-DC converter in order to discharge any residual charge on the high voltage storage means.

* * * * *